US009171413B2

(12) United States Patent
Kataoka et al.

(10) Patent No.: US 9,171,413 B2
(45) Date of Patent: Oct. 27, 2015

(54) PAPER PROCESSING APPARATUS AND PAPER PROCESSING SYSTEM

(75) Inventors: Hiroki Kataoka, Tokyo (JP); Takeshi Yamagata, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 411 days.

(21) Appl. No.: 13/599,948

(22) Filed: Aug. 30, 2012

(65) Prior Publication Data

US 2013/0047869 A1 Feb. 28, 2013

(30) Foreign Application Priority Data

Aug. 30, 2011 (JP) ..... 2011-187787

(51) Int. Cl.

| | |
|---|---|
| ***B30B 9/30*** | (2006.01) |
| ***G07D 3/00*** | (2006.01) |
| ***G07D 7/00*** | (2006.01) |
| ***G07D 11/00*** | (2006.01) |

(52) U.S. Cl.

CPC ..... *G07D 11/0021* (2013.01); *B30B 9/30* (2013.01); *G07D 11/0084* (2013.01)

(58) Field of Classification Search

CPC ..... G07D 11/0084; G07D 11/0096; G07D 11/0021; G07D 7/0026; B07C 5/34; B30B 9/30; G07F 7/04; G07F 19/20; G07F 19/202

USPC ..... 100/33 PB, 25; 194/302, 206, 207; 53/587, 589; 209/534

See application file for complete search history.

(56) References Cited

U.S. PATENT DOCUMENTS

| | | | | |
|---|---|---|---|---|
| 5,909,814 | A * | 6/1999 | Arikawa | 209/534 |
| 5,996,314 | A * | 12/1999 | Pennini et al. | 53/399 |
| 2004/0079683 | A1* | 4/2004 | Utz et al. | 209/534 |
| 2005/0139447 | A1* | 6/2005 | Minamishin et al. | 194/206 |
| 2007/0122023 | A1 | 5/2007 | Jenrick et al. | |
| 2008/0106726 | A1* | 5/2008 | Park | 356/71 |

FOREIGN PATENT DOCUMENTS

| | | | |
|---|---|---|---|
| CN | 1650331 | A | 8/2005 |
| CN | 101075363 | A | 11/2007 |
| CN | 101339676 | A | 1/2009 |
| JP | 11-045365 | A | 2/1999 |
| JP | 2004-157624 | A | 6/2004 |
| JP | 2008-210258 | A | 9/2008 |
| JP | 2011-113152 | A | 6/2011 |
| WO | WO-2004/019287 | A1 | 3/2004 |
| WO | WO-2011/078177 | A1 | 6/2011 |

* cited by examiner

*Primary Examiner* — Jimmy T Nguyen
(74) *Attorney, Agent, or Firm* — Rabin & Berdo, P.C.

(57) ABSTRACT

A paper processing apparatus includes a discriminating unit. The discriminating unit can discriminate papers inserted into the papers processing apparatus. Discriminated papers are ejected to storage compartments based on discrimination results. Only papers that are discriminated as counterfeit are ejected to one of the storage compartments.

7 Claims, 12 Drawing Sheets

FIG. 10

DO YOU NEED TO EJECT
COUNTERFEIT BILL TO
REJECTING PORTION?

● YES ○ NO

AFTER SELECTION
PLEASE PUSH
COUNT START BUTTON

FIG. 11

PLEASE SELECT EJECTION PATTERN
ABOUT BILL EXEMPTED FROM BINDING

| | EJECTING PORTION | REJECTING PORTION |
|---|---|---|
| ● | COUNTERFEIT BILL | OTHER |
| ○ | OTHER | COUNTERFEIT BILL |
| ○ | MISMATCHED BILL | OTHER |

PAPER PROCESSING APPARATUS AND PAPER PROCESSING SYSTEM

CROSS-REFERENCE TO RELATED APPLICATION

This application claims priority under 35 U.S.C. §119 from Japanese Patent Application NO. P 2011-187787, filed on Aug. 30, 2011, the entire disclosure of which is incorporated herein by reference.

BACKGROUND

1. Technical Field

This application relates to a paper processing apparatus and system, such as a bill-binding machine and system that can sort and count bank bills based on categories thereof, can store the sorted bills in temporary storage compartments, and can bind respective predetermined numbers of the bills into separate bundles with tape.

2. Description of the Related Art

Bill-binding machines are arranged in locations that treat a large numbers of bills. The bill-binding machine can separate the bills inserted into the bill-binding machine according to operator-assigned categories, such as their denominations, whether or not the bills are damaged or counterfeit, and can bind respectively predetermined numbers of the categorized bills into separate bundles with tape. The machine can also pass the bills bound into bundles to an ejected bill storage compartment, and can eject bills exempted from binding to a rejected bill storage compartment. However, the bill-binding machine ejects all bills exempted from binding to the rejected bill storage compartment regardless of the reason for the exemption. There are various reasons that certain bills are rejected, such as a determination that they are counterfeit bills or of an unknown denomination (e.g., foreign bank bills). Therefore, the operator cannot treat the rejected bills uniformly after the rejection, and needs to determine reasons for the rejections for each bill individually.

SUMMARY OF THE DISCLOSURE

This application discloses aspects of a paper processing apparatus and a paper processing system that can treat counterfeit papers by discriminating them from other authentic or genuine ones.

According to one aspect, a paper processing apparatus that receives papers to be discriminated can include a discriminating unit, and at least two storage compartments. The discriminating unit can discriminate the received papers. The two storage compartments store discriminated papers. A conveying means conveys the discrimination papers to the storage compartments based on the discrimination results and conveys to one of the storage compartments only papers that are discriminated as counterfeit.

According to another aspect, a paper processing system can include a paper processing apparatus and an external discrimination apparatus. The paper processing apparatus that receives papers to be discriminated can include a discriminating unit that examines received papers to obtain feature information that is used for discrimination among inserted storage compartments that receive discriminated papers based on discrimination results. The external discrimination apparatus, which can be connected to the paper processing apparatus, can discriminate papers based on the feature information it receives from the paper processing apparatus, and can send the discrimination results thereto. One of the storage compartments receives only papers that are discriminated as counterfeit.

BRIEF DESCRIPTION OF THE DRAWINGS

The paper processing apparatus and the paper processing system will be more fully understood from the following detailed description with reference to the accompanying drawings, which is given by way of illustration only, and is not by way of limitation.

FIG. 10 is an explanatory view illustrating a screenshot that requires assignment by an operator of an ejection aperture for counterfeit bills of while the bill-binding machine is in a counting mode.

FIG. 11 is an explanatory view illustrating a screenshot that requires assignment by the operator of an ejection pattern for bills exempted from binding and storing them in the bill-binding machine while the bill-binding machine is in a bill-binding mode.

DETAILED DESCRIPTION

Embodiment

An embodiment of a bill-binding machine 100 serving as a paper processing machine 100*a* will be described with reference to the drawings.

Figure 1:
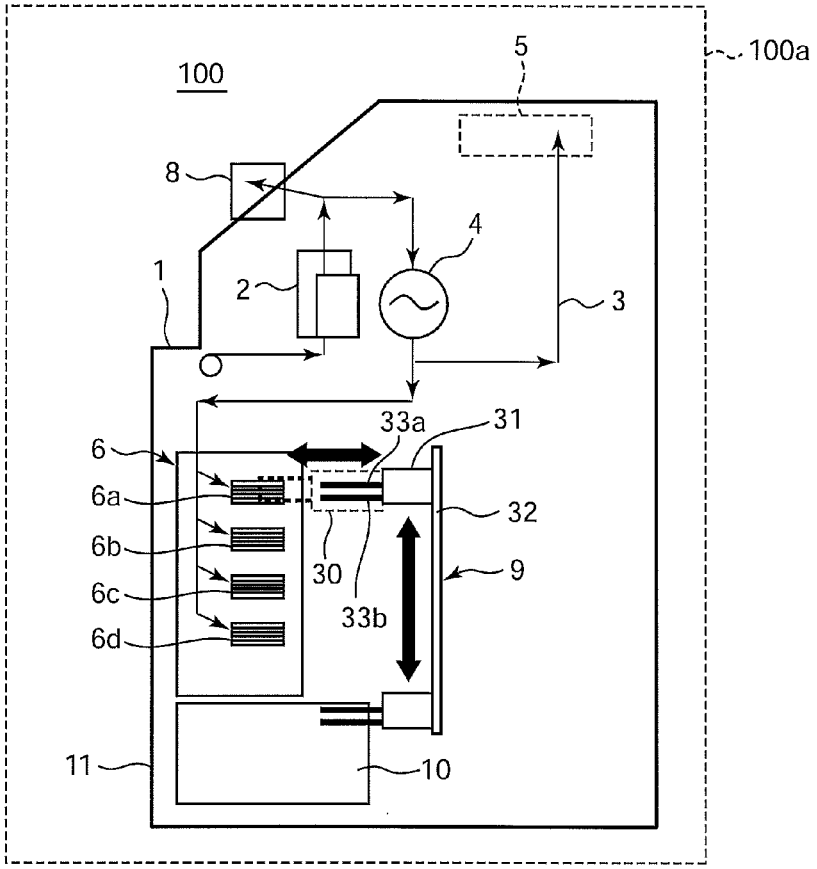
FIG. 1 is a schematic side view illustrating a structure of a bill-binding machine serving as the paper processing apparatus.
Figure 2:
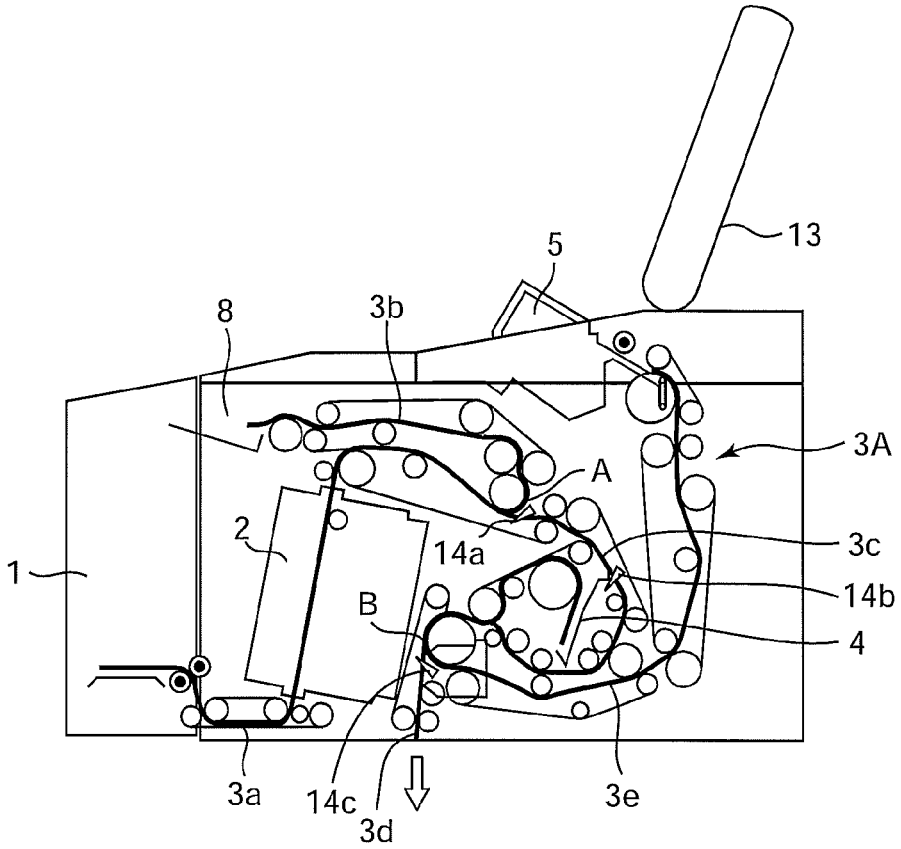
FIG. 2 is an enlarged side view illustrating an upper structure of the bill-binding machine shown in FIG. 1.

FIG. 1 is a schematic side view illustrating the structure of the bill-binding machine 100 serving as the paper processing apparatus 100*a*. FIG. 2 is an enlarged side view illustrating an upper structure of the bill-binding machine 100 shown in FIG. 1.

A slot 1 into which bank bills can be inserted can be arranged on a front upper side of the bill-binding machine 100. A discriminating unit 2 can be arranged inside of the bill-binding machine 100. The discriminating unit 2 can discriminate: the authenticity of an inserted bill, the denomination of the bill, damage to the bill, between an old and a new bill, and between the front and back of a bill. The discriminating unit 2 also can count bills and detect an abnormal transport of bills. These discriminations can be executed by detecting reflected light from or a permeation of light through a bill using the discriminating unit 2 while exposing the bill to ultraviolet light or visible light, detecting magnetism included in the ink of a circulatable bank bill, or measuring a dimension of a bill. For example, the discriminating unit 2 can discriminate whether a bill is counterfeit or not, and whether a bill is a dirty, clean, damaged or undamaged bill. A transport path 3, along which the discriminated bills can be conveyed, will be described later. A reverse member 4 that can reverse the two sides of a bill based on one or more commands from a controller 50 (described later) can be arranged downstream of the discriminating unit 2.

An ejected bill storage compartment 5 can be arranged at an upper side of the bill-binding machine 100. The bills assigned in an operating mode of the bill-binding machine 100 or by an operator, such as bills exempted from storage in the bill-binding machine 100 and binding, can be ejected to the ejected bill storage compartment 5 based on one or more commands from the controller 50. The operator can assign an operating mode of the bill-binding machine 100 so that the machine ejects only counterfeit bills to the ejected bill storage compartment 5, and the operator can directly access ejected counterfeit bills.

A rejected bill storage compartment 8 can store bills that have been discriminated as rejected bills in the discriminating unit 2. The rejected bill can be a damaged bill, an old bill, or a bill determined to have received abnormal transport. Rejected bills other than counterfeits can be ejected to the rejected bill storage compartment 8, which can be arranged at an upper side of the slot 1 so that the operator can directly access the rejected bills.

A maximum number (limit) of the bills that can be ejected to the rejected bill storage compartment 8 can be prescribed (e.g., a maximum number of 100 bills). Therefore, it is possible to prevent the number of the rejected bills from exceeding the prescribed maximum number, thereby to avoid the rejected bills from falling from the compartment 8. For example, if the number of rejected bills reaches the maximum number, the bill-binding machine 100 can display information requesting that insertion of bills be temporarily stopped, in order to allow the operator time to remove the rejected bills from the compartment.

However, if numerous bills that have a strong curl or folds have been ejected to the rejected bill storage compartment 8, the rejected bills can fall from the rejected bill storage compartment 8 before the number of the rejected bills reaches the prescribed (maximum) number. Therefore, a height sensor 25 that can detect whether or not the rejected bill storage compartment 8 is full can be arranged. As a result, even if the number of the rejected bills does not reach the prescribed maximum, the bill-binding machine can operate as with the operation in the case of the number of rejected bills reaching the predetermined number after the height sensor 25 detects that the compartment 8 is full.

Figure 6:
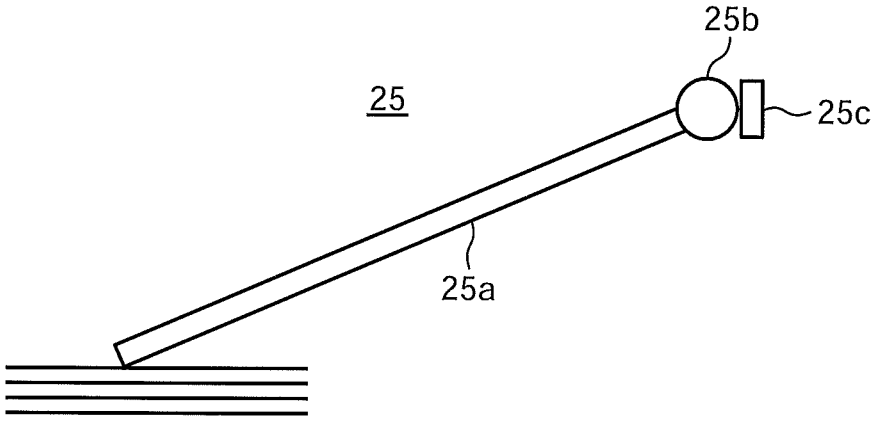
FIG. 6 is a schematic side view illustrating a height sensor arranged in a rejected bill storage compartment of the bill-binding machine.

FIG. 6 is a schematic side view illustrating the height sensor 25 arranged on the rejected bill storage compartment 8 of the bill-binding machine 100. The height sensor 25 can include an arm 25*a*, an edge receiver 25*b*, and a main sensor 25*c*. The arm 25*a* can be arranged with respect to a side of the rejected bill storage compartment 8 so that a front edge of the arm 25*a* is arranged at a predetermined height, held by the edge receiver 25*b*. The edge receiver 25*b* can rotatably support the front edge of the arm 25*a*. The main sensor 25*c* can detect rotation of the arm 25*a* through the edge receiver 25*b*, and can output a detecting signal if the arm 25*a* rotates through a predetermined angle. Thus with the rejected bills stacked beneath the rear edge of the arm 25*a*, as the rejected bills increase in number, a surface of the top rejected bill pushes up the rear edge of the arm 25*a* so that the arm 25*a* rotates in the edge receiver 25*b*, and the main sensor 25*c* outputs a detection signal after the arm 25*a* has rotated through the predetermined angle.

Figure 3:
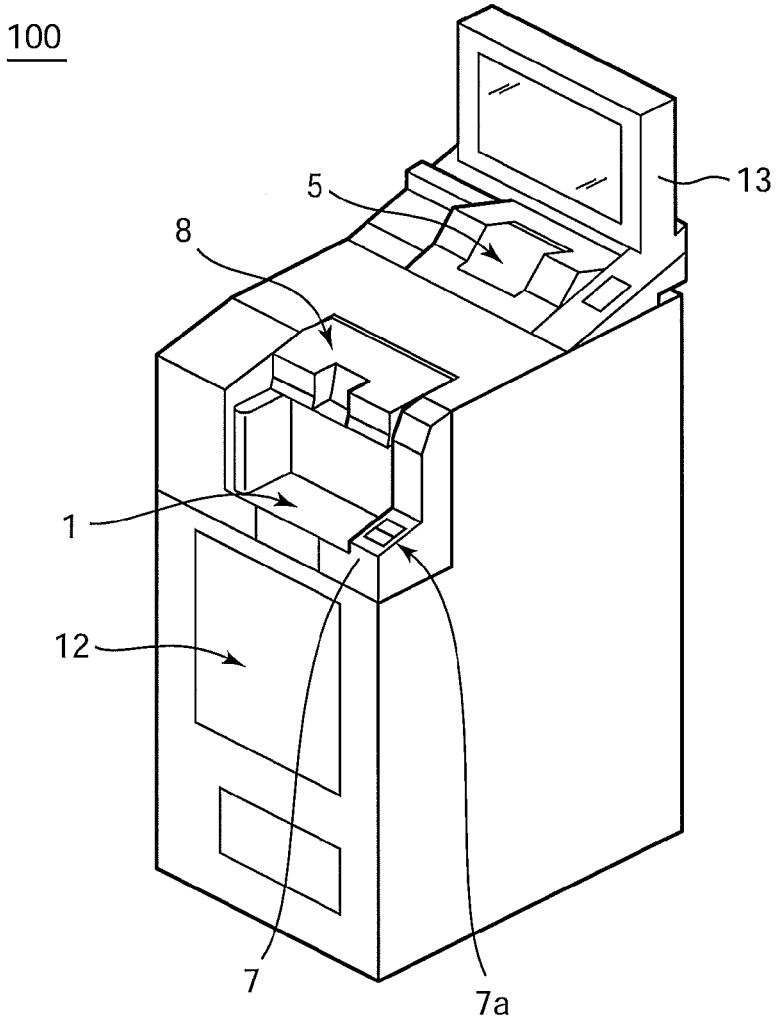
FIG. 3 is a perspective view illustrating the appearance of the bill-binding machine.
Figure 4:
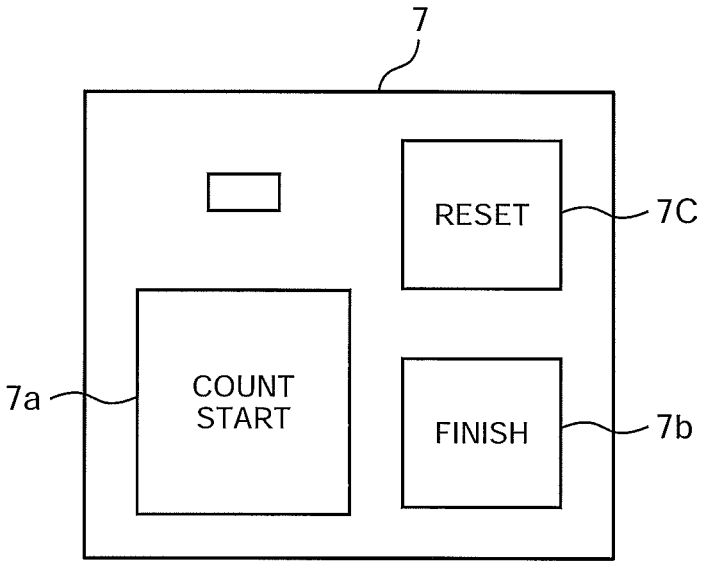
FIG. 4 is an enlarged plan view illustrating an operating portion of the bill-binding machine.

FIG. 3 is a perspective view illustrating the appearance of the bill-binding machine 100. FIG. 4 is an enlarged plan view illustrating an operating portion 7 of the machine. The operating portion 7 can be arranged at one side of the slot 1 (e.g., the right side). The operating portion 7 can include a count start button 7*a*, a finish button 7*b*, and a reset button 7*c*. For example, the count start button 7*a* can be used when the operator wishes to count the bills. The finish button 7*b* can be used by the operator when counting or binding of the bills has been completed. The reset button 7*c* can be used when the operator wishes to restart of the bill-binding machine 100, for example if a technical problem in the machine has occurred.

An operating display 13 can be arranged on a back side of the ejected bill storage compartment 5 in the machine's upper side. The operating display 13 can include a liquid crystal display with a touch panel on its surface. The operator can select an operating mode, denominations of the bills that are to be stored in temporary storage compartments 6*a*-6*d* (described later), and an order of bill storage. Also, the denominations of the bills, the authenticity of the bills, and the counted number of the bills can be indicated on the operating display 13.

As shown in FIG. 1, a storing mechanism 6 that can include four temporary storage compartments 6*a*, 6*b*, 6*c*, and 6*d* arranged vertically in a line can be arranged in the bill-binding machine 100. The temporary storage compartments 6*a*-6*d* can each store bills of a predetermined denomination up to the predetermined number (e.g., 100). Naturally, the number of temporary storage compartments is not limited to four.

A transport structure 9 can carry the bills stored in the temporary storage compartments 6*a*-6*d* to a bill-binding unit 10. The bill-binding unit 10 can bind the carried bills into a bundle using a binding material such tape. The transport structure 9 and the bill-binding unit 10 can be arranged in the bill-binding machine 100. Details of the transport structure 9 and the bill-binding unit 10 will be described later. An ejection aperture 11 can be used to eject the bills bound by the bill-binding unit 10. A door 12 arranged at a front upper side of the ejection aperture 11 can be opened by the operator so that he can access the storing mechanism 6.

The transport path 3 can be defined by transport members 3A such as rollers, transport belts, sensors that can detect passage of the bills, and driving motors. Also, as shown in FIG. 2, the transport path 3 can include transport paths 3*a*, 3*b*, 3*c*, 3*d*, and 3*e*, and two diversion points (rejection diversion point A and storage diversion point B, described below), and the transport members can further include switching blades 14, including blades 14*a*, 14*b* and 14*c*. The switching blade 14*a* is arranged at the rejection diversion point A. The switching blade 14*b* is arranged at an entry of the reversing unit 4. The switching blade 14*c* is arranged at the storage diversion point B. The blades can be triangularly-shaped, and can each rotate on a supporting point thereof.

The transport path 3*a* can extend from the slot 1 to the rejection diversion point A through the discriminating unit 2. All bills inserted into the slot 1 can be conveyed on the transport path 3*a* to the rejection point A.

The transport path 3*b* can extend from the rejection diversion point A to the rejected bill storage compartment 8. The bills that are discriminated as rejected bills can be diverted to the transport path 3*b* to be carried or conveyed to the rejected bill storage compartment 8 by rotation of the switching blade 14*a* under the control of the controller 50 in response to discrimination results from the discrimination unit 2, so as to block the transport path 3*c*.

The transport path 3*c* can extend from the rejection point A to the storage diversion point B. The reversing unit 4 can be arranged midstream of the transport path 3*c*. Also, the bills can be carried on the transport path 3*c* so as not to pass through the reversing unit 4, by rotation of the switching blade 14*b* under the control of the controller 50 in response to discrimination results from the discrimination unit 2, so as to block the transport path 3*c*. The reversing unit 4 can have a grooved-shape, so that if the carried bill is inserted in the reversing unit, the bill can be rotated 180 degrees to turn the bill over, and the carried bill is then ejected from the reversing unit. Bills that are inserted in the slot 1 but not carried to the rejected bill storage compartment 8 can be carried on the transport path 3*c*. Then, bills that have been determined to be rotated 180 degree can be inserted into the reversing unit 4.

The transport path 3*d* can extend from the storage diversion point B to the temporary storage compartment 6*d* as shown in FIG. 1. Bills that have been discriminated as ones to be stored and bound into bundles can be carried on the transport path 3*d*, and these bills can be respectively carried into the temporary storage compartments 6*a*-6*d*.

The transport path 3*e* can extend from the storage diversion point B to the ejected bill storage compartment 5. The bills that have been discriminated as ones to be ejected to the ejected bill storage compartment 5 can be carried there on the transport path 3*e* by rotation of the switching blade 14*c* under the control of the controller 50 in response to discrimination results from the discrimination unit 2, so as to block the transport path 3*d*.

Figure 5:
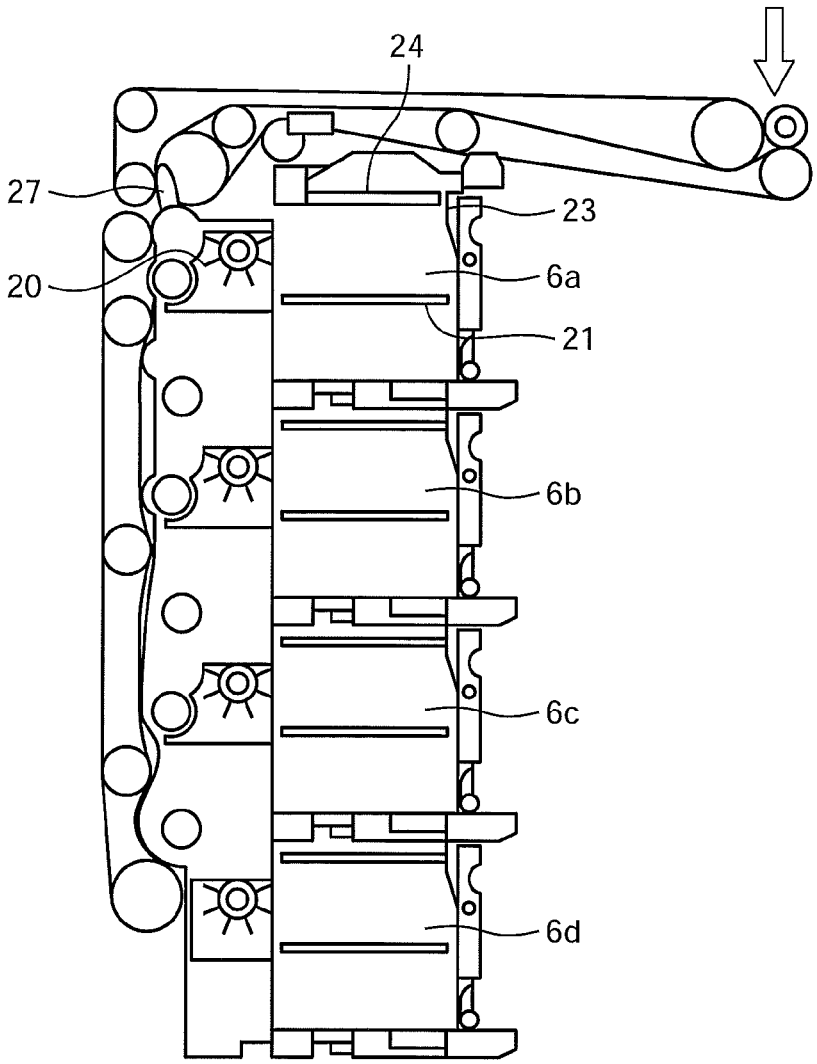
FIG. 5 is a side view illustrating a storing mechanism of the bill-binding machine.

FIG. 5 is a side view illustrating the storing mechanism 6 of the bill-binding machine 100. As described above, the storing mechanism 6 can include the four temporary storage compartments 6*a*-6*d* arranged vertically in a line. The temporary storage compartments 6*a*-6*d* can have the same structure. The temporary storage compartment 6*a* will described as an example.

The temporary storage compartment 6*a* can include a sorting gate 27, a storing board 21, and a bladed wheel 20. The sorting gate 27 can move so that bills that have been discriminated for storage in the temporary storage compartment 6*a* can be carried there. The storing board 21 can store the bills carried from the sorting gate 27. The bladed wheel 20 can push an edge of the bills toward the storing board 21. For example, bills that have passed along the transport path 3*d* can be brought toward the storing board 21, the edge of the bills can be pushed by the bladed wheel 20, and the bills can be stored on the storing board 21. Further bills carried from the transport path 3*d* can be stored on the storing board 21 in the same manner.

The bills stored in the temporary storage compartment 6*a* can be straightened in their length direction by a straightening member (not illustrated) arranged at one side of the compartment in its length direction so that the bills are respectively straightened in that direction. Also, the bills can be straightened in their width direction by a straightening member 23 arranged at an end side of the temporary storage compartment 6*a* in the bill inserting direction so that a width direction of the bill is straightened.

If the number of bills stored in the temporary storage compartment 6*a* (e.g., a value of a counter 52*a* that will be described later) exceeds the standard number by an increase of the bills stored on the storing board 21, the storing board 21 can automatically drop so as to enlarge the space of the temporary storage compartment 6*a*. Therefore, even if the height of a stored stack of bills is individually different based on a crinkle or a fold line in a bill, the bills can be stored in a stable manner on the storing board 21. On an upper side of the storing board 21, a pushing board 24 that can push the bills stored on the storing board 21 can be arranged so as to face the storing board 21. The pushing board 24 can stand by for pushing the bills at the upper side of the temporary storage compartment 6*a* so as to prevent contacting the bills while the bills are inserted into the temporary storage compartment 6*a*.

If the number of bills stored on the storing board 21 reaches the limit (e.g., 100 bills), the sorting gate 27 can operate so as not to carry additional bills to the temporary storage compartment 6*a*, but instead can be directed to another temporary storage compartments 6*b*, 6*c*, or 6*d*.

After the insertion of bills into the temporary storage compartment 6*a* is finished, the bills stored in the temporary storage compartment 6*a* can be sandwiched by the storing board 21 moving upward toward the top of the temporary storage compartment 6*a* and the pushing board 24 moving downward toward the underside thereof to compress the stack of bills therebetween. As a result, the widths of all the bills, including bills that are crinkled or have creases and other unsmooth states can be made uniform. Then, the sandwiched bills can be carried by a bill clamping unit 30 of the transport structure 9 (illustrated in FIG. 1) into the storage compartment 6*a* past the straightening member 23 in the length direction of the bills.

A respective display (not illustrated) can be arranged adjacent to each of the temporary storage compartments 6*a*-6*d*. Information that can be indicated on the display includes denomination and number of the bills stored in the compartment, and whether the bills are circulatable (in a condition suitable for circulation) or damaged.

As shown in FIG. 1, the transport structure 9 can include the bill clamping unit 30, a clamp moving structure 31 that moves the clamping member horizontally, and a vertical moving structure 32 that moves the bill clamping member and clamp moving structure vertically.

Next, the movement of the transport structure 9 in case of transporting bills stored in the temporary storage compartment 6*a* to the bill-binding member 10 for binding bills will be described by way of example. When the stored bills are carried from the storage compartment 6*a* to the bill-binding member 10, the bill clamping unit 30 and the clamp member moving structure 31 can move vertically to the temporary storage compartment 6*a*. Then, if a position sensor corresponding to the temporary storage compartment 6*a* detects the clamp member moving structure 31, the clamp member moving structure 31 is stopped, and clamped in place by a clamp member (not illustrated) at a position corresponding to the temporary storage compartment 6*a*. Then, clamp members 33*a* and 33*b* of the bill clamping unit 30 respectively move in up and down directions, and the bill clamping unit 30, e.g., the clamp members 33*a* and 33*b* are pushed into the temporary storage compartment 6*a* by the moving structure 31. The clamp members 33*a* and 33*b* are inserted into an opening in the temporary storage compartment 6*a*. The opening extends into the storage compartment 23 in the length direction of the bills being inserted, and can sandwich the bills through gaps in the storing board 21 and the pushing board 24. After the sandwiching of the bills between the storing board 21 and the pushing board 24 is released, the clamp members 33*a* and 33*b* that sandwich the bills can withdraw from the compartment 6*a* to an original position shown in FIG. 1. After the clamp members are moved to the original position, the moving structure 31 can be released so that the clamp members 33*a* and 33*b* (with the bills sandwiched therebetween) and the clamp member moving structure 31 are moved to the bill-binding member 10 arranged at the lowest part of the bill-binding machine 100. Then, the bills are released from the clamp members 33*a* and 33*b* at the bill-binding member 10.

Figure 7:
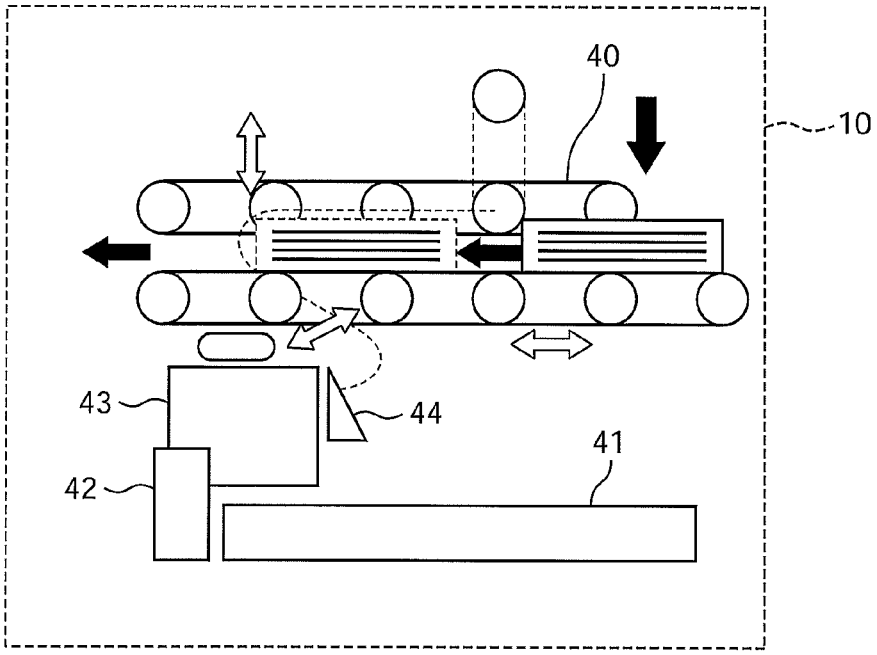
FIG. 7 is a side view illustrating a bill-binding member of the bill-binding machine.

FIG. 7 is a side view schematically illustrating the bill-binding member 10 of the bill-binding machine 100. As shown in FIG. 7, the bill-binding member 10 can include a transport member 40 having rollers and belts, a binding tape 41, such as a paper tape, a printing member 42, a tape supply member 43 that supplies the binding tape 41, a cutter 44 that cuts the binding tape 41 into predetermined length, and a binding member (not illustrated).

Next, a binding process will be described. First, the transport member 40 can receive a stack of bills for binding from the bill clamping unit 30, and can carry the bills to a binding position. The tape supply member 43 can supply the binding tape 41 to the binding member, and the printing member 42 can print information on the binding tape 41 about the bound bills. After the printing, the tape 41 can be cut into predetermined lengths by the cutter 44, and the binding member can loop the printed tape 41 around the bills to form a bundle. Then, the bundle of bills can be carried to the ejecting aperture 11 by the transport member 40.

Also, if some bills that are not bound remain in the temporary storage compartments 6*a*-6*d* after operations of counting and storing all bills inserted into the slot 1, the operator can access the remained bills by opening the door 12.

Next, information that can be printed on the binding tape 42 and a structure of the printing member 42 will be described.

The bill-binding machine 100 can assign the bills for binding, based on their denominations and conditions of the bills.

The condition of a bill can be separated into three variations. E.g., in a first condition, the bill has been little-used and may be characterized as a brand-new bill, and is appropriate for disbursement by an automated teller machine (ATM), and the bill is called an ATM fit bill. In a second condition, damage to the bill is severe, and is appropriate for return to a bank of issue (e.g., a Federal Reserve Bank), and the bill is called a damaged bill. In a third condition, a bill is not appropriate disbursement by an ATM, but the damage is not so severe as to require its return to the bank of issue, and the bill is called a circulation bill. Therefore, for example, circulatable bills can be separated and bound into bundles of ATM fit bills and circulation bills.

External dimensions of bills can diminish due to curling, folding, and a decreasing of elastic force of the bill. Also, over a long period of time, bills become degraded due to surface grime. Therefore, the discriminating unit 2 can detect whether a bill should be treated as an ATM fit bill, a circulation bill, or a damaged bill, by comparing measured dimensions of the bill to a threshold value, and comparing a measured gradation of a design of a predetermined part to a threshold value of gradation. The threshold values can be assigned by the operator.

The printing member 42 can include a stamp part, and a printing part. The stamp part can include a stamp that forms a character (e.g., "D" meaning damaged) that indicates a damaged bill. The printing member 42 can be limited to only one stamp as a measure to limit the size of the bill-binding member 10, and thereby the overall size of bill-binding machine 100. However, the number of stamps can be increased if desired. The printing part can print a numeric character (e.g., a running number) on the binding tape 41. The printing part can print the number of bills that are bound into a bundle by the tape, and can also print a recognized character indicating that the bundle of bills are ATM fit bills, circulation bills, or damaged bills. Also, it is noted that normally information regarding denominations of the bills are not required to be printed because it is easy for the operator to determine bill denominations by confirming the design of the bound bills. However, information of denominations of the bills can be printed on the binding tape 41 if desired.

The position of the stamp can be a center part of a surface of the binding tape 41. The number of bound bills can be printed on the right or left side of the stamped position of the binding tape 41. A common category or characteristic of the bills bound together by the binding tape 41 can be printed on the tape in any desired fashion. For example, if the bundle of bills consists of ATM fit bills, or circulation bills, or damaged bills, a corresponding numeric character "1" or "2" or "3" may be printed on the binding tape 41. Also, if the ATM fit bills and the circulation bills are to be bound together based on their characteristic that they are all circulatable, a numeric character "4" can be printed on the binding tape 41.

Figure 8:
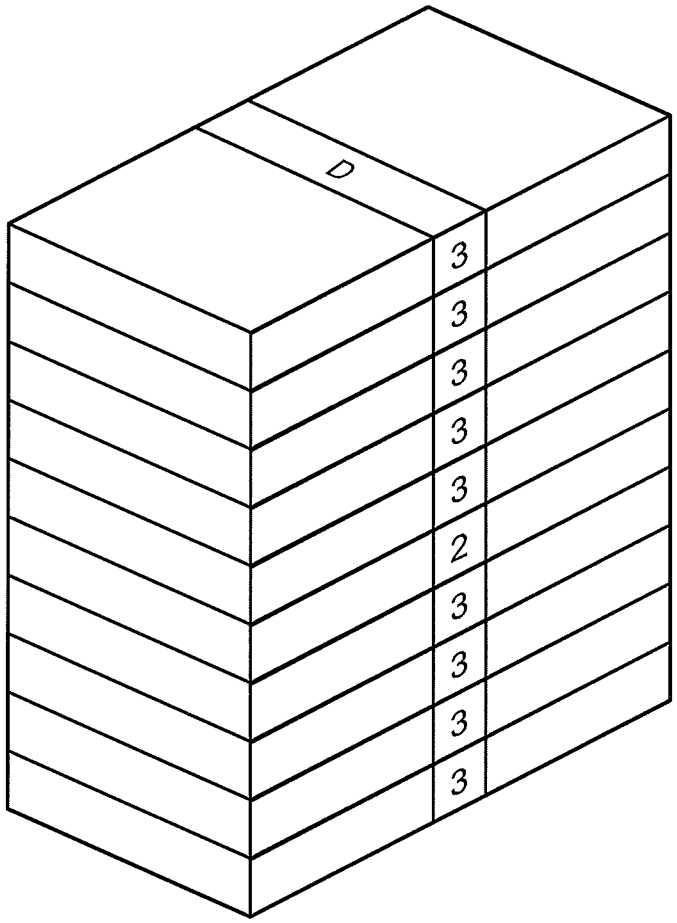
FIG. 8 is a perspective view illustrating stacked bills that have been bound into bundles by the bill-binding machine.

After a stack of bills has been bound into a bundle, it can be piled together with others and further bundled by the operator. FIG. 8 is a perspective view illustrating stacked bills that have been bound into bundles by the bill-binding machine 100. Since any one of the numeric character "1-4" can be printed on the binding tape 41 placed on the side of each bundle of bills, even if the bundles are piled on one another, the operator can easily determine whether the bound bills are ATM fit bills, circulation bills, damaged bills, or the circulatable bills consisting of ATM fit bills and/or circulation bills.

Figure 9:
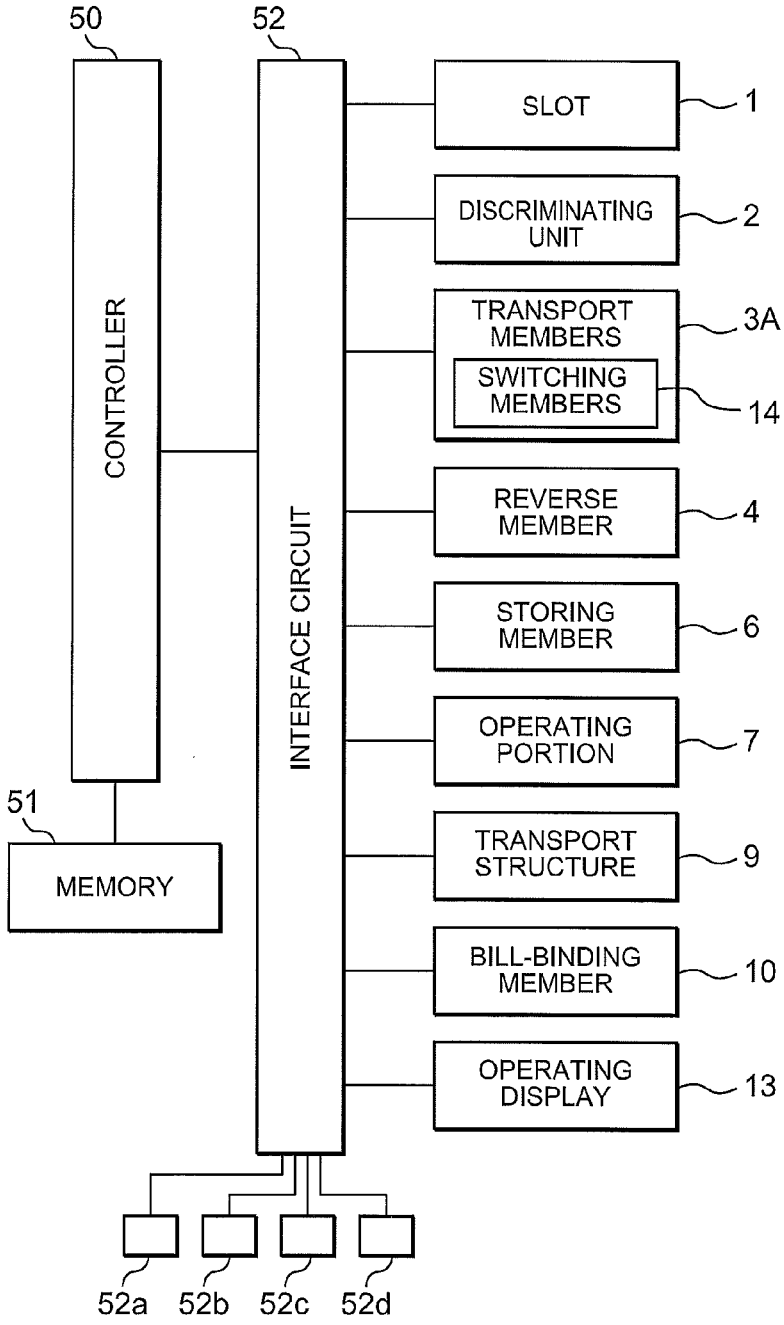
FIG. 9 is a block diagram illustrating a control system of the bill-binding machine.

FIG. 9 is a block diagram illustrating a control system of the bill-binding machine 100. Its controller 50 can be composed of, for example, a micro computer, and can control the entire operation of the bill-binding machine 100. A memory 51 can include a program memory, a working memory, and a control data memory. The controller 50 can control any members included in the bill-binding machine 100 based on programs stored in the program memory, and data stored in the control data memory, by using a working memory as a temporary information memory. Also, the memory 51 can store a result of an aggregated classification that will be described later.

The controller 50 can connect to elements associated with the slot 1, such as a motor, a solenoid, and a sensor, the discriminating unit 2, the transport members 3A defining the transport path 3, the reverse member 4, the storing mechanism 6, the operating portion 7, the transport structure 9, the bill-binding member 10, the operating display 13, and the counters 52*a*-52*d* through a interface circuit 52.

The counters 52*a*-52*d* respectively correspond to the temporary storage compartments 6*a*-6*d*, and respectively count the numbers of times that time sensors at the temporary storage compartments 6*a*-6*d* detect insertion of the bills into the respective compartments. In the embodiment, the counters 52*a*-52*d* are hardware counters. However, a software counter configured by the controller 50 using the memory 51 can be used.

Operation

Next, operations of the bill-binding machine 100 will be described.

After the bill-binding machine 100 is turned on, the controller 50 can cause the operating display 13 to show an initial screen, and the operator can select a deposit mode or a straightening mode by touching one of the mode choices indicated on the initial screen. In the deposit mode, the bill-binding machine 100 can count inserted bills, can separate and tally results of such counting for each transaction and every predetermined classification, and can store separated and tallied results in the memory 51. In the straightening mode, the separated and tallied results cannot be stored in the memory 51.

Next, in the deposit mode or the straightening mode, detailed operating modes are selected. The detailed operating modes can include, for example, four modes. In a first mode, called herein a counting mode, only counting of the bills can be executed. In a second mode, called herein an assigned denomination binding mode, the bills of assigned denominations can be bound without separating the ATM fit bills, the circulation bills, or the damaged bills. In a third mode, called herein a circulatable bill-binding mode, the bills can be separated based on the assigned denominations, and the bills corresponding to the ATM fit bill and the circulation bill can be respectively bound. In a fourth mode, called herein a circulatable and damaged bill-binding mode, the bills can be separated based on the assigned denominations, and the bills corresponding to the ATM fit bill, the circulation bill, and the damaged bill can be respectively bound. The operator can select one of the four modes from a selection screen of the detailed operating mode indicated in the operating display 13. The detailed operating modes are not limited to the described four modes. The operator can select other modes, such as only the ATM fit bills being bound, only the circulation bills being bound, or all circulatable bills being bound without separating into the ATM fit bills and the circulation bills.

FIG. 10 is an explanatory view illustrating a screenshot with instructions that require assignment by the operator of an ejection destination for counterfeit bills while the bill-binding machine 100 is in the counting mode (first mode). If the first mode is selected by the operator, the controller 50 can cause the operating display 13 to display the screen shown in FIG. 10 with instructions that require selecting whether or not the counterfeit bills are to be ejected to the rejected bill storage compartment 8 of the operator. Then, after the selection, the bill-binding machine 100 can start to operate in response to the operator pushing the start button.

In the first mode, bills inserted into the slot 1 can be carried to the discriminating unit 2, and discrimination of denominations of the bills and counting of the bills can be executed. If ejecting counterfeit bills to the rejected bill storage compartment 8 is not selected by the operator, all discriminated bills can be ejected to the ejected bill storage compartment 5. Also, if such ejecting is selected, all discriminated bills other than the counterfeit bills can be ejected to the ejected bill storage compartment 5, and the counterfeit bills can be ejected to the rejected bill storage compartment 8.

In the second, third, and fourth modes, denominations of the bills stored in the temporary storage compartments 6*a*-6*d*, and the damage level of the bills used for discrimination can be automatically assigned by the controller 50, or can be respectively assigned with respect to the temporary storage compartments 6*a*-6*d* by the operator. Information regarding the bills stored in the temporary storage compartments 6*a*-6*d* can be stored in the memory 51.

FIG. 11 is an explanatory view illustrating a screenshot that instructs the operator to assign an ejecting pattern of the bills that are not to be bound and stored in the bill-binding machine 100 while the bill-binding machine 100 is in the bill-binding mode (first, second, or third mode). The controller 50 can cause the operating display 13 to display the screen shown in FIG. 11 that instructs the operator to select the ejecting pattern of the bills other than bills that will be bound or ejected, to the ejected bill storage compartment 5 and the rejected bill storage compartment 8.

As shown in FIG. 11, for example, three optional patterns can be displayed on the operating display 13 as ejecting patterns. In the first ejecting pattern, counterfeit bills can be ejected to the ejected bill storage compartment 5. Further, bills other than bills that will be bound or ejected to the ejected bill storage compartment 5, such as bills of denominations that will not be bound or stored and bills of unknown denomination, can be ejected to the rejected bill storage compartment 8.

In the second rejecting pattern, counterfeit bills can be ejected to the rejected bill storage compartment 8, and other bills described above can be ejected to the ejected bill storage compartment 5. In the third ejecting pattern, mismatched bills can be ejected to the ejected bill storage compartment 5, and bills other than bills to be bound, such as the counterfeit bills, and bills of unknown denomination, can be ejected to the rejected bill storage compartment 8.

If the operator has found a counterfeit bill while operating the bill-binding machine 100, he or she may need to respond differently than with respect to other bills. For example, the operator may need to contact law enforcement. Therefore, treatment of counterfeit bills can be made an exception in the first and second ejecting patterns.

In the described embodiment, the operator can select one of the three ejecting patterns. However, the ejecting pattern can be assigned by the controller 50 based on the selected mode. For example, the binding modes can respectively correspond to the ejecting patterns, a combination of the binding modes and the denominations of the bills that are to be stored and the denominations of the bills that are to be bound can respectively correspond to the ejecting patterns, or combinations of the binding modes and the ejecting patterns can be arbitrarily set by the operator.

After the ejecting pattern has been selected, the operator can insert bills into the slot 1, and then by pushing the count starting button 7*a* can cause the bill-binding machine 100 to start counting, storing, and binding the inserted bills. Then, the inserted bills can be individually separated, and can be conveyed from the slot 1 to the discriminating unit 2 along the transport path 3*a*. The discriminating unit 2 can discriminate the authenticity, denominations, damage, age (old and new), and exposed side (front or back) of the bills, can count the bills, and can detect abnormal transport of the bills. As a result, the bills that have been detected and determined to be stored in the storing mechanism 6, can be conveyed to the reverse member 4 along the transport path 3*c*, and part of these bills that need to be reversed, can be rotated by 180 degrees, so that the two sides of the bills that are stored in the storing mechanism 6 can be matched. Then, the bills can be conveyed to the storing mechanism 6 along the transport path 3*d*, and can be stored in the temporary storage compartments 6*a*-6*d*. Also, the bills that have been detected and determined not to be stored in the storing mechanism 6, can be conveyed to the ejected bill storage compartment 5 or the rejected bill storage compartment 8 based on the selected ejecting pattern. For example, if the first ejecting pattern has been selected, then if an inserted bill is detected as a counterfeit bill, the inserted bill can be conveyed to the ejected bill storage compartment 5 along the transport paths 3*c* and 3*e*, and if the inserted bill is detected as a bill of unknown denomination, the inserted bill can be conveyed to the rejected bill storage compartment 8 along the transport path 3*d*.

Also, if the number of the bills ejected to the rejected bill storage compartment 8 reaches a predetermined number as described earlier, e.g., the height sensor 25 detects by the main sensor 25*c* detecting the predetermined angle of the arm member 25*a*, that the rejected bill storage compartment 8 has reached its full capacity, acceptance of the inserted of the bill, discrimination of the bill, and transport of the bill are stopped temporarily. Then, after the operator clears the ejected bills, the operation of the bill-binding machine 100 can be restarted by the operator touching the restart button indicated on the operating display 13.

According to the bill-binding machine 100, it is possible to handle easily the counterfeit bills after ejection, because among the bills that are not to be stored and bound, the counterfeit bills may be ejected exclusively to a designated ejection destination.

Also, the ejected bill storage compartment 5 and the rejected bill storage compartment 8 that have already been arranged in the bill-binding machine 100 can be used as the exclusive ejection destination for counterfeit bills, so it is not necessary to arrange for a new ejection destination. Therefore, it is possible to eject only counterfeit bills to a particular ejection destination without the need for an enlarged and complicated bill-binding machine.

Other Variation

In the described embodiment, the bill-binding machine 100 includes two ejection destinations (the ejected bill storage compartment 5 and the rejected bill storage compartment 8). However, the bill-binding machine 100 can include three ejection destinations. In this case, one or two of the three ejection destinations, can be used exclusively for counterfeit bills. If two of the three ejection destinations are used exclusively for counterfeit bills, these two ejection destinations can be respectively used according to two separate methods of discrimination. For example, the ejection destinations can be decided based on whether the bills are discriminated according to serial numbers printed on the bills or patterns printed on a predetermined part.

Thus, if the bill-binding machine 100 includes two ejection destinations, the counterfeit bills discriminated according to the serial numbers printed on the bills can be ejected to a particular ejection destination, and the counterfeit bills discriminated according to the pattern printed on a predetermined part can be ejected to the other of the two ejection destinations that can be used also for bills of unknown denomination. In this case, it is possible to separate the counterfeit bills discriminated by the serial numbers to be fake with 100 percent certainty, from the other counterfeit bills discriminated by the pattern, which often cannot be judged as fake with 100 percent certainty due to errors in the discrimination caused by dirt or markings in a predetermined part, and to eject these to groups of bills respectively to different destinations.

Figure 12:
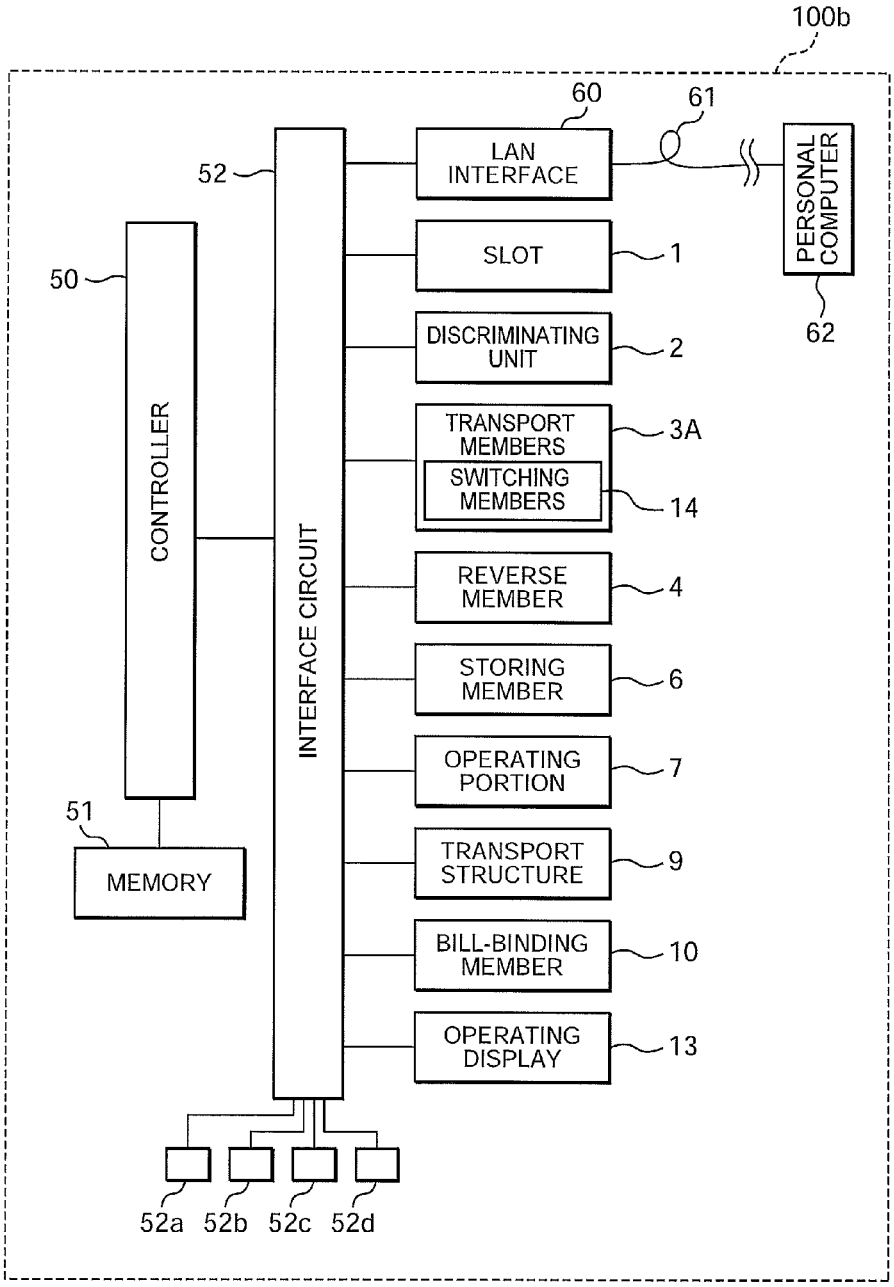
FIG. 12 is a block diagram illustrating a control system of another embodiment of a bill-binding system serving as a paper processing machine.

Also, the discriminating unit 2 executes all discrimination processes. However, an external apparatus (e.g., a personal computer) can execute part of the discrimination processes. FIG. 12 is a block diagram illustrating a control system of a bill-binding system 100*b* serving as a paper processing system according to other variations. Elements identical to those of FIG. 9 are designated by the same reference numbers, and results based on inclusion of the identical elements will be incorporated herein by reference.

As shown in FIG. 12, a LAN interface 60 can connect to the interface circuit 52. A LAN cable 61 can detachably connect to the LAN interface 60, and a personal computer 62 can connect to the LAN cable 61. In this variation, the discriminating unit 2 can send read image data of the bills to the controller 50. The controller 50 can clip part of the image data used for the discrimination from the read image data, and can send the clipped image data to the personal computer 62 after compressing it. The personal computer 62 can extract the clipped image data used for the discrimination of authenticity of the bills from received compression image data, can discriminate the authenticity of bills, can store results of the discrimination in a memory of the personal computer 62, and can send the results to the controller 50. The controller 50 can perform a separating process on the discriminated bills based on the received results.

In this variation, even if new counterfeit bills are brought into circulation, it is possible easily to add information to the personal computer 62 or rewrite existing information therein taking into account the new counterfeit bills, in order to target these counterfeits for separation in the discrimination. As a result, in the discriminating unit 2, only minimum discrimination, such as detection of denomination or damage, may be executed, so that processing in the bill-binding machine 100 can be sped up. Also, detection of denomination or damage can be executed in the personal computer 62, and the function of the discriminating unit 2 can be limited to that of an image scanner.

Also, a buffer, such as a FIFO (First In First Out) unit, can be arranged between the discriminating unit 2 and the personal computer 62 in order to prevent a processing delay by communication therebetween. Also, if counterfeit bills have been found by the discriminating unit 2, the controller 50 can cause the operating display 13 to display information regarding the position where the counterfeit bills are placed, and further information regarding the serial numbers of the counterfeit bills.

Also, part or all of the destinations for the bills that are not found and stored can include a cover, or can be arranged inside of the bill-binding machine 100 so that the operator cannot directly access the bills.

Also, in this embodiment, the bill-binding machine 100 has been described as a bank bill processing machine. However, the bill-binding machine 100 is not limited to a bank's bill processing machine in. The embodiment can be applied to an apparatus that discriminates inserted bills, separates counterfeit bills from a primary transport path, and ejects counterfeit bills to the particular ejection aperture. For example, an embodiment that can satisfy these conditions can be applied to an ATM.

Also, in this embodiment, a bill-binding machine 100 that can handle a bank bill has been described as a bank bill processing machine. However, in other embodiments the above-described features can be applied to handling a cash voucher, such as a check or a money coupon, instead of a bank bill.

What has been described above includes examples of embodiments represented by the appended claims. It is, of course, not possible to describe every conceivable combination of components or methodologies encompassed by the claims, but it should be understood that many further combinations and permutations are possible. Accordingly, the claims are intended to embrace all such combinations, permutations, alterations, modifications and variations that fall within the spirit and scope of the claims. Moreover, the above description, and the abstract, are not intended to be exhaustive or to limit the spirit and scope of the claims to the precise forms disclosed.

What is claimed is:

1. A paper processing apparatus that receives papers to be discriminated, comprising:

a discriminating unit that discriminates the received papers;

at least two storage compartments that store discriminated papers;

an operating portion that permits an operator to designate, before the papers have been received by the paper processing apparatus, whether papers that have been discriminated as being counterfeit based on a predetermined discrimination standard are to be stored in a selected one of the storage compartments, the selected one of the storage compartments being a counterfeit storage compartment that stores only papers discriminated as being counterfeit based on the predetermined discrimination standard; and means for conveying the discriminated papers to the storage compartments based on discrimination results;

wherein said means conveys only papers that have been discriminated as being counterfeit if the operator has designated that papers which have been discriminated as being counterfeit based on the predetermined discrimination standard are to be stored in the counterfeit storage compartment.

2. The paper processing apparatus of claim 1, wherein the at least two storage compartments comprise more than two storage compartments, wherein the predetermined discrimination standard is a first discrimination standard, and wherein another of the storage compartments receives only papers that have been discriminated as being counterfeit based on a second discrimination standard that is different than the first discrimination standard.

3. The paper processing apparatus of claim 2, wherein the papers are composed of bank bills, and the first discrimination standard is based on serial numbers printed on the bank bills.

4. The paper processing apparatus of claim 1, wherein the discrimination unit discriminates the received papers based on the condition of the papers, and further comprising:

a binding unit that binds the stored papers using binding tape after the number of the stored papers reaches a predetermined number; and a printing unit that prints at least one character indicating the condition on the binding tape.

5. The paper processing apparatus of claim 1, wherein said means includes transport members arranged to define at least three transport paths for the papers, the transport paths including an incoming path, and outgoing paths connecting to the storage compartments and to each other at a diversion point, and a switching member arranged at the diversion point, and responsive to the discrimination results to convey along the transport paths to the counterfeit storage compartment only the papers discriminated as being counterfeit based on the predetermined discrimination standard.

6. The paper processing apparatus of claim 4, wherein the printing unit prints the at least one character on the binding tape at the side of the bundle of papers.

7. The papers processing apparatus of claim 1, wherein the papers are legal tender paper money.

* * * * *